United States Patent [19]

Rogers

[11] 4,138,254

[45] Feb. 6, 1979

[54] PHOTOGRAPHIC PRODUCTS COMPRISING ANTI-LIGHT PIPING DYES

[75] Inventor: Howard G. Rogers, Weston, Mass.

[73] Assignee: Polaroid Corporation, Cambridge, Mass.

[21] Appl. No.: 702,149

[22] Filed: Jul. 2, 1976

Related U.S. Application Data

[63] Continuation of Ser. No. 408,052, Oct. 19, 1973, abandoned, which is a continuation-in-part of Ser. No. 194,406, Nov. 1, 1971, abandoned, which is a continuation-in-part of Ser. No. 101,841, Dec. 28, 1970, abandoned.

[51] Int. Cl.[2] ..... G03C 7/00; G03C 1/40; G03C 1/84; G03C 5/54

[52] U.S. Cl. ..... 96/29 D; 96/3; 96/76 C; 96/77; 96/84 R

[58] Field of Search ..... 96/76 R, 76 C, 77, 84 R, 96/3, 29 D

[56] References Cited

U.S. PATENT DOCUMENTS

| | | | |
|---|---|---|---|
| 2,391,127 | 12/1945 | Carver | 96/84 R |
| 2,622,026 | 12/1952 | Hunter et al. | 96/84 R |
| 3,282,699 | 11/1961 | Jones et al. | 96/84 R |
| 3,340,062 | 5/1967 | Hunter et al. | 96/85 R |
| 3,351,470 | 11/1967 | McCune | 96/77 |
| 3,415,644 | 12/1968 | Land | 96/77 |
| 3,594,165 | 7/1971 | Rogers | 96/77 |
| 3,647,437 | 3/1972 | Land | 96/77 |

FOREIGN PATENT DOCUMENTS

| | | | |
|---|---|---|---|
| 732985 | 11/1969 | Belgium. | |
| 874985 | 6/1971 | Canada. | |
| 972050 | 10/1964 | United Kingdom | 96/67 |

OTHER PUBLICATIONS

*Kodak Tech Bits* No. 2, 1967, Eastman Kodak Co., Rochester, N.Y.

*Kodak Tech Bits* No. 2, 1966, Eastman Kodak Co., Rochester, N.Y.

"Kodak Solar Flare Film (Estar Base)", Kodak Data Release, Eastman Kodak Co., Rochester, N.Y. 11/1968.

Mees, "The Structure of the Developed Image", *The Theory of the Photographic Process*, pp. 384–386, early ed.

Mees, *The Theory of the Photographic Process*, p. 501, MacMillan Co., New York, (1966).

"Miscellaneous Properties" *Manual of Physical Properties of Kodak Aerial & Special Sensitized Mat'ls*, Eastman Kodak Co., 6/1961.

*Primary Examiner*—Richard L. Schilling

*Attorney, Agent, or Firm*—Stanley H. Mervis; John P. Morley

[57] ABSTRACT

Diffusion transfer photographic products and processes involving film units having an anti-light piping capability so that the film units can be exposed in a dark chamber of a camera, withdrawn from the dark chamber while distributing an opaque processing composition between elements of the unit to protect the unit from further exposure and transported into light before distribution of the opaque processing composition is complete.

19 Claims, 7 Drawing Figures

PHOTOGRAPHIC PRODUCTS COMPRISING ANTI-LIGHT PIPING DYES

CROSS REFERENCE TO RELATED DISCLOSURES

This application is a continuation of U.S. application Ser. No. 408,052 filed Oct. 19, 1973, which in turn is a continuation-in-part of U.S. patent application Ser. No. 194,406 filed Nov. 1, 1971 (now abandoned) which in turn is a continuation-in-part of U.S. patent application Ser. No. 101,841 filed Dec. 28, 1970 (now abandoned).

BACKGROUND OF THE INVENTION

Various photographic systems for forming photographic images by diffusion transfer have heretofore been disclosed. Common to such systems, whether black-and-white or color, is that a photosensitive element containing a developable image is developed and an imagewise distribution of image-forming constituents formed as a function of development is transferred to a superposed image-receiver layer to impart thereto the desired transfer image. The image-receiving layer may be separate from the photosensitive element, e.g., contained on a separate support member, or it may be contained on the same support carrying the photosensitive layer or layers. In either instance, the image-receiving layer containing the transfer image may be separated after image formation to provide the photographic print or in lieu thereof, systems are also known wherein the receiving layer is not separated but is maintained in association with the remaining layers of the film unit.

While the present invention is directed to the aforementioned film units in general and systems employing them wherein development is effected in the presence of actinic light, i.e., processing outside the camera, it is particularly directed to so-called integral negative-positive film units for forming color transfer images.

Generally, such film units comprise a plurality of essential layers including at least one light-sensitive silver halide layer and associated dye image-providing material and a dyeable stratum. These essential layers may be contained on a transparent dimensionally stable layer or support member positioned closest to the dyeable stratum. Opacifying means are provided on either side of the photosensitive strata so that the film unit may be processed in the light to provide the desired color transfer image. In a particularly useful embodiment, such opacifying means comprises an opaque dimensionally stable layer or support member positioned on the side of the photosensitive strata opposed from the dyeable stratum to prevent photoexposure by actinic light incident thereon from this side of the film unit and an opacifying agent applied during development between the dyeable stratum and the photosensitive strata, e.g., by including the opacifying agent in a developing composition so applied in order to prevent further exposure (fogging) by actinic light incident thereon from the other side of the film unit when the thus exposed film unit is developed in the light.

While the transfer images obtained from the film unit to which this invention is directed may be separated from the remaining layers of the film unit following development in the light to provide the desired photographic print, of particular interest are those integral negative-positive film units adapted for forming transfer images which are viewable, without separation, as reflection prints.

As examples of such integral negative-positive film units for preparing color transfer images viewable without separation as reflection prints, mention may be made of those described and claimed in U.S. Pat. Nos. 3,415,644, 3,415,645, 3,415,646; 3,473,925; 3,594,164 and 3,594,165; as well as those described and claimed in U.S. Pat. Nos. 3,573,043; 3,573,044 and 3,672,890.

In general, the film units of the foregoing description, e.g., those described in the aforementioned patents and/or copending applications, are exposed to form a developable image and thereafter developed by applying the appropriate processing composition to develop exposed silver halide and to form, as a function of development, an imagewise distribution of diffusible dye imageproviding material which is transferred, at least in part, by diffusion, to the dyeable stratum to impart thereto the desired color transfer image, e.g., a positive color transfer image. Common to all of these systems is the provision of a reflecting layer between the dyeable stratum and the photosensitive strata to mask effectively the latter and to provide a background for viewing the color image contained in the dyeable stratum, whereby this image is viewable without separation from the other layers or elements of the film unit. In certain of these systems, this reflecting layer is provided prior to photoexposure, e.g., as a preformed layer included in the essential layers of the laminar structure comprising the film unit, and in others it is provided at some time thereafter, e.g., by including a suitable light-reflecting agent, for example, a white pigment such as titanium dioxide, in the processing composition which is applied between the dyeable stratum and the next adjacent layer to develop the latent image and to form the color transfer image.

The dye image-providing materials which may be employed in such processes generally are selected from the known materials for use in diffusion transfer which are either (1) initially soluble or diffusible in the processing composition but are selectively rendered non-diffusible as a function of development; or (2) initially insoluble or non-diffusible in the processing composition but are selectively rendered diffusible as a function of development. These materials may be complete dyes or dye intermediates, e.g., color couplers.

As examples of initially soluble or diffusible materials and their application in color diffusion transfer, mention may be made of those disclosed, for example, in U.S. Pat. Nos. 2,647,049; 2,661,293; 2,698,244; 2,698,798; 2,802,735; 2,774,668 and 2,983,606. As examples of diffusion transfer systems employing initially non-diffusible materials, mention may be made of the materials and systems disclosed in U.S. Pat. Nos. 3,443,939; 3,443,940; 3,227,550; 3,227,551; 3,227,552, 3,227,554; 3,243,294 and 3,445,228.

Common to all of the systems is that color transfer image formation is predicated upon a differential in mobility or diffusibility obtained by chemical action as a function of development. This chemical action may, for example, be a redox reaction or a coupling reaction.

Other imaging systems employing other types of reactions, e.g., selective dye formation or destruction, etc. have also heretofore been suggested.

In any of these systems, multicolor images are obtained by employing a film unit containing at least two selectively sensitized silver halide layers each having associated therewith a dye image-providing material exhibiting desired spectral absorption characteristics. The most commonly employed elements of this type are the so-called "tripack" structures employing a blue-, a green- and red-sensitive silver halide layer having associated therewith, respectively, a yellow, a magenta and a cyan dye image-providing material.

A particularly useful system for forming color images by diffusion transfer is that described in U.S. Pat No. 2,983,606, employing dye developers (dyes which are also silver halide developing agents) as the dye image-providing materials. In such systems, a photosensitive element comprising at least one silver halide layer having a dye developer associated therewith (in the same or in an adjacent layer) is developed by applying an aqueous alkaline processing composition. Exposed and developable silver halide is developed by the dye developer which in turn becomes oxidized to provide an oxidation product which is appreciably less diffusible than the unreacted dye developer, thereby providing an imagewise distribution of diffusible dye developer in terms of unexposed areas of the silver halide layer, which imagewise distribution is then transferred, at least in part, by diffusion, to a dyeable stratum to impart thereto a positive dye transfer image. Multicolor images may be obtained with a photosensitive element having two or more selectively sensitized silver halide layers and associated dye developers, a "tripack" structure of the type described above and in various patents including the aforementioned U.S. Pat. No. 2,983,606 being especially suitable for accurate color recordation of the original subject matter.

In the systems described above, for development to be carried out in the light, it has been found to be necessary to include an opacifying agent in the processing composition. This opacifying agent may be the above-mentioned reflecting agent or it may be an additional reagent or mixture or reagents which in combination with the reflecting agent provides the requisite opacity to prevent fogging by actinic light incident thereon, e.g. transmitted through the transparent support member, when the film unit is processed in the light.

In a particularly useful system for initiating development, the processing fluid is applied as the exposed film unit is advanced from the exposing apparatus into the light. This is readily accomplished, for example, by providing the processing fluid, including opacifying agent, in a rupturable container of known description positioned in a processing relationship along a leading edge of the film unit and adapted for spreading of its contents in a substantially uniform layer between selected layers. Suitable pressure means, e.g., a pair of superposed rollers, are provided adjacent the exit passage of the exposing apparatus so that when the film unit is advanced therethrough into the light, the compressive force thus provided ruptures the container and causes spreading of the processing fluid.

In this manner, as the film unit is brought out into the light, the processing fluid containing the opacifying agent has been applied so as to preclude fogging by actinic light incident on the applied layer of processing fluid. However, by a phenomenon sometimes referred to as "light piping" it has been found that some fogging can occur along the rear portion of the film unit, i.e., that portion last removed from the exposing apparatus. This fogging is in no way caused by a defect in the opacifying agent or agents employed, but is caused by light incident on that portion outside the camera being transmitted within the film unit into the exposure apparatus to that portion of the film unit to which the processing composition has not yet been applied and hence is unprotected by the application of the opacifying agent.

To illustrate this phenomenon further, imagine one exposing such a film unit in a camera and then very slowly pulling the film unit through a pair of pressure rollers into the light. As the film unit is thus slowly advanced, the processing fluid is slowly applied so that the portion outside of the camera has the fluid applied and is protected by the opacifying agent while that portion still in the camera has not yet had the fluid applied and is not yet protected from the light, except, of course, for the fact that it is still in the dark chamber of the camera. While light striking that portion of the film unit outside the camera cannot fog those corresponding portions of the film unit, due to the presence of the opacifying agent, a portion of this light may be reflected internally and scatters or diffuses along the film unit to expose and hence fog that portion of the film unit still inside the camera to which the processing fluid has not yet been applied.

While, for purposes of explaining the problem, reference has been made to pulling the film unit very slowly from the camera, it will be appreciated that, because of the great speed of light, no mechanical system yet devised for advancing the film unit is fast enough to prevent this phenomenon from occurring.

It is to this problem to which the present invention is directed.

SUMMARY OF THE INVENTION

In accordance with the practice of the present invention, the above discussed potential fogging problem can be virtually eliminated by integrating a layer containing a chemical system on the side of the photosensitive stratum to which the opacifying agent-containing processing fluid is applied. The chemical system so employed is distinctively characterized in that it can preclude the aforementioned fogging phenomenon but yet does not adversely affect the quality of an image viewed therethrough or the quality of an image obtained by exposure therethrough. Accordingly, the chemical system containing layer obviates the aforementioned problem so that the photosensitive strata are protected from fogging from one side by light incident on the applied layer of processing fluid by the opacifying agent contained therein, any fogging by "light-piping" being obviated effectively by the layer containing the chemical system. The photographic products of the present invention are further characterized in that an opacifying capability, e.g., an opaque layer, is disposed on the side of the photosensitive strata opposed from that on which the processing fluid is applied so that the film unit may then be developed in the light.

A primary object of this invention, therefore, is to provide novel photographic products of the foregoing description.

Another object is to provide novel products adapted for use in photographic systems for forming images by diffusion transfer wherein a layer of opacifying reagent is applied as the film unit is advanced into the light, the layer of opacifying reagent being sufficient to prevent fogging by actinic light incident thereon.

Still another object is to provide novel photographic products containing a plurality of essential layers including a receiving layer for forming an image by diffusion transfer contained on a dimensionally stable transparent layer or support member and which, because of the application during development of an opacifying agent, are adaptable for processing in the presence of light actinic to the photosensitive layer or layers, the novel photographic products being constructed and arranged so as to include in a layer or layers on the side of the photosensitive layers to which the opacifying agent is applied a chemical system which precludes the heretofore mentioned fogging phenomenon.

Other objects of the invention will in part be apparent to those skilled in the art and/or will in part appear hereinafter.

The invention accordingly comprises the several steps and the relation and order of one or more of such steps with respect to each of the others, and the product possessing the features, properties and the relation of elements which are exemplified in the following detailed disclosure, and the scope of the application of which will be indicated in the claims.

DESCRIPTION OF THE PREFERRED EMBODIMENTS

Figure 1:
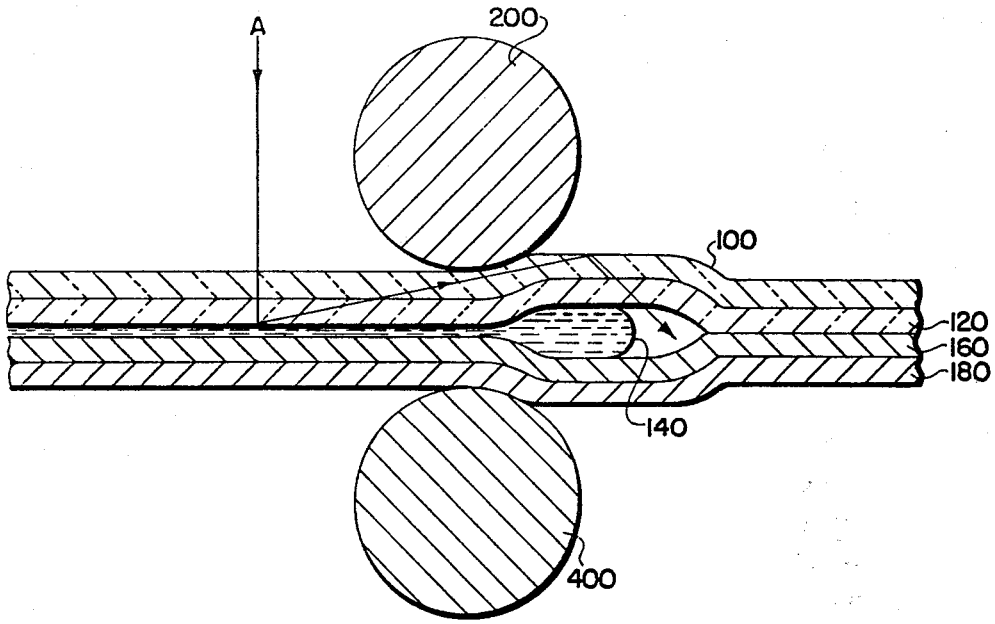
FIGS. 1 and 2 illustrate cross-sectional views, greatly magnified, of essential elements of exposed photographic products of the present invention undergoing processing by passing the product between pressure applying members, e.g., rollers 200 and 400.
Figure 2:
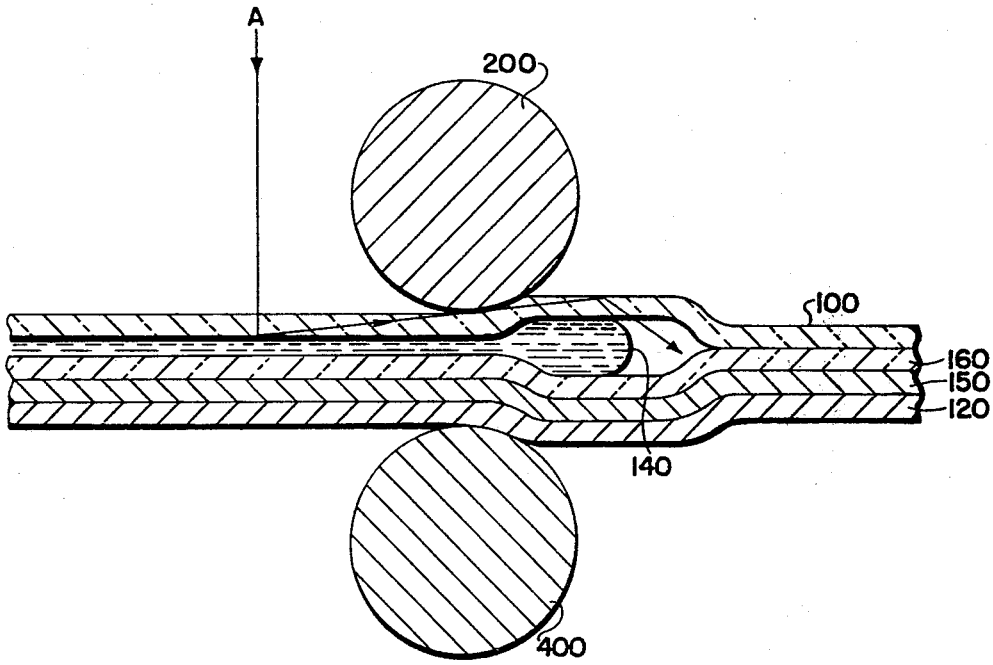

For a fuller understanding of the aforementioned fogging phenomenon to which this invention is directed, reference should be had to FIGS. 1 and 2 which illustrate film units within the scope of this invention undergoing processing by passing the exposed film units between pressure-applying members, e.g., rollers 200 and 400. As shown in FIG. 1, the film unit comprises a transparent layer 100, an image-receiving layer 120 adapted for receiving a diffusion transfer image upon application of processing composition 140 between layer 120 and photosensitive layer 160, e.g., a gelatino silver halide emulsion, contained on layer or support member 180 which is preferably opaque. Processing composition 140 is distributed between layers 120 and 160 as the film unit is advanced into the light after passage between the pair of superposed pressure-applying rollers 200 and 400. Composition 140 includes an opacifying system so as to prevent fogging from light incident thereon after the film unit has been advanced through the rollers into the light.

Photographic products of the type shown in FIG. 1 are described in more detail in U.S. Pat. Nos. 3,415,644; 3,415,645 and 3,415,646 which relate to diffusion transfer photographic products wherein the color image on an image receptive stratum is viewed by reflection through a transparent, dimensionally stable layer. Also in some of the products disclosed in said patents, the photosensitive system is exposed through the transparent layer. Accordingly, the degree of transparency of such layers is an important consideration in such photographic products which can control and affect such features as the overall quality of images viewed through such layers and in some instances, the overall quality of images obtained by exposure therethrough.

The photographic products of the present invention also includes those of the type shown in FIG. 2. Essential elements of products of this type include a processing composition 140 containing an opacifying system, adapted to be distributed between transparent layer 100 and photosensitive system 160. Other essential elements of such products include an opaque layer 150 permeable to diffusion transfer components, interposed between the photosensitive system 160 and a diffusion transfer image receptive stratum 120 which may be contained on a second dimensionally stable layer or support member (not shown). Products of the type shown in FIG. 2 are described in more detail in U.S. Pat. Nos. 3,594,164 and 3,594,165.

It should be pointed out that the degree of transparency of layer 100 is an important consideration in such products since photosensitive system 160 is normally exposed through layer 100 and accordingly this feature can directly control and affect the ultimate quality of the image obtained in receptive stratum 120.

As stated, the photographic products of the present invention additionally provide a chemical system containing layer for preventing transmission of light to portions of the photosensitive layer or layers still in the dark which are temporarily unprotected by the opacifying system or agent. The integration of this chemical system containing layer with photographic products of the type to which the present invention pertains provides an effective solution to the potential fogging problem which is considered to be unique and inherent in the structural elements of the photographic products of the present invention and/or the manner by which such products are processed.

The fogging encountered in products of the present invention is peculiar in that it is considered to be caused by light passing through that portion of the transparent layer 100 outside the camera and then being reflected, scattered or otherwise transmitted transversely (internally) to that portion of the exposed photosensitive layer 160 inside the camera which has not yet been protected by the opacifying system.

The above discussed fogging can perhaps be better appreciated by reference to FIGS. 1 and 2 which illustrate in very simplified fashion a proposed scheme of multiple internal reflections which a ray of light (Ray A) can undergo to fog a portion of photosensitive layer 160 which has not been protected by the opacifying system. It is presently considered that the cause of such fogging is due to an effect somewhat analogous to a "light-piping effect" as opposed to an effect known to the art as "edge fog" or "end fog." As those skilled in the art know, "edge fog" or "end fog" manifests itself most commonly on edges and ends of photographic roll or cartridge films because of unwanted exposure of the films such as during the loading or handling outside the camera. In contrast thereto, the aforesaid fogging avoided by photographic products of the present invention — but which has been encountered in products heretofore known to the art — occurs primarily in that portion of the product which passes through rollers 200 and 220 last, e.g., that portion of photosensitive layer 160 which last receives the protection of the opacifying system.

In accordance with the practice of the present invention, transmission of light to such unprotected portions of photosensitive layer 160 can be effectively prevented by integrating a layer comprising a chemical system on the side of the photosensitive layer where the processing fluid is applied, e.g., preferably in receiving layer 120 of the illustrative film unit of FIGS. 1 and/or in a contiguous layer, and preferably on transparent layer 100 in the film unit of FIG. 2. The chemical system in said layer being characterized in that it can obviate this fogging caused by light scatter and/or reflection, but does not prevent viewing or exposure through said layer.

Particular reagents especially suitable in the practice of the present invention are dyes known to the art as "antihalation dyes". Such dyes can be readily dispersed in a plastomeric matrix to provide sheets or layers initially having the light absorption capability of the aforementioned characteristics. Alternatively, dispersions of such dyes can be coated on other layers of the photographic product to provide suitable auxiliary protective layers. In addition to providing layers that are initially light absorbing, the antihalation dyes can interact with diffusion transfer image processing compositions so that the diffusion transfer image can be viewed in or through layers containing the products of the interaction.

As mentioned, antihalation dyes are known to the art. They are described, for example, in U.S. Pat. Nos. 3,471,293; 3,469,985; 3,440,051; 3,389,994; 3,384,487; 3,364,029; 3,352,680; 3,340,062; and 3,005,711 and in British Pat. No. 515,998; all of which are incorporated herein by reference. Particularly preferred are those antihalation dyes which can provide the desired absorption capability initially, but which interact with the processing composition at a rapid rate so that the absorption capability initially present is cleared quickly from the dye-containing layer. Triarylmethane dyes, for example, are especially suitable in the present invention.

Representative dyes suitable in the practice of the present invention include the following, among others:

1.

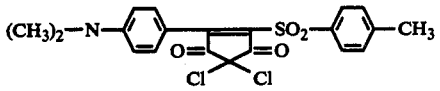

2.

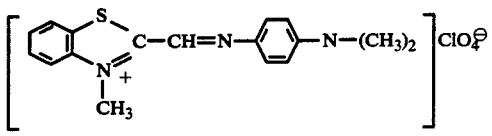

3.

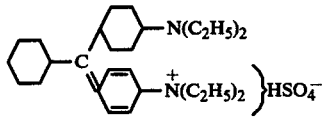

(Color Index 42040)

4.

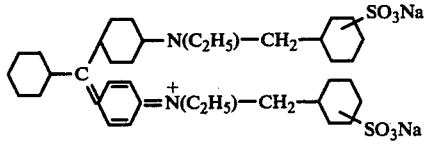

(Color Index 42095)

5.

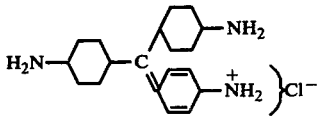

(Color Index 42500)

-continued

Zinc double chloride of

6.

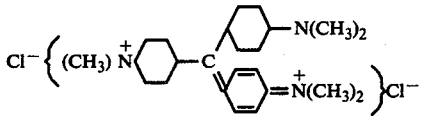

(Color Index 42585)

The amount of dye or dyes required to provide an effective protective layer can vary depending upon the particular dye or combination thereof employed. However, the best balance of desired properties is obtained when the amount employed is sufficient to provide a layer which has an optical density — as measured on the side of the layer at 700 Mμ — of at least about 5.0 and preferably 6.0. In most instances, the amount of dye required to provide the desired optical density is extremely low with respect to the matrix material of the layer containing the dye. For example, with certain dyes or combinations thereof suitable protective layers can be obtained by employing 2 milligrams of dye per 5 grams of polymer. Quite surprisingly, layers containing such a relatively minor amount of dye can effectively prevent the potential fogging problem described before. Equally important, the relatively minor amount of dye employed does not affect to any appreciable extent, the speed or sensitivity of the light sensitive system of the product. Instead, the photosensitive system can be readily exposed to activating radiation through the auxiliary protective layer comprising the dye to install an image pattern in the photosensitive system which can be developed to provide a good quality diffusion transfer image.

As was mentioned previously, the preferred film units to which this invention is directed are those integral negative-positive film units or composite structures which are adapted for forming color images viewable without separation as reflection prints. Specific film units of this description are illustrated in FIGS. 3–8.

Figure 3:
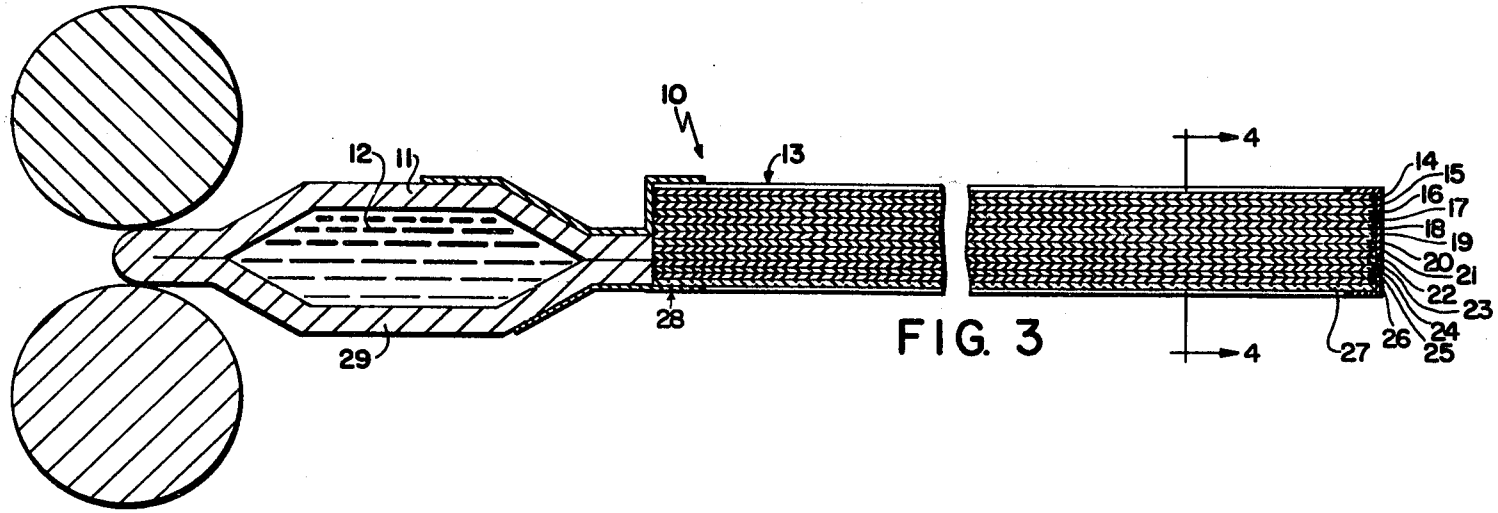
FIGS. 3 and 4 illustrate cross-sectional views of photographic products of the present invention.
Figure 4:
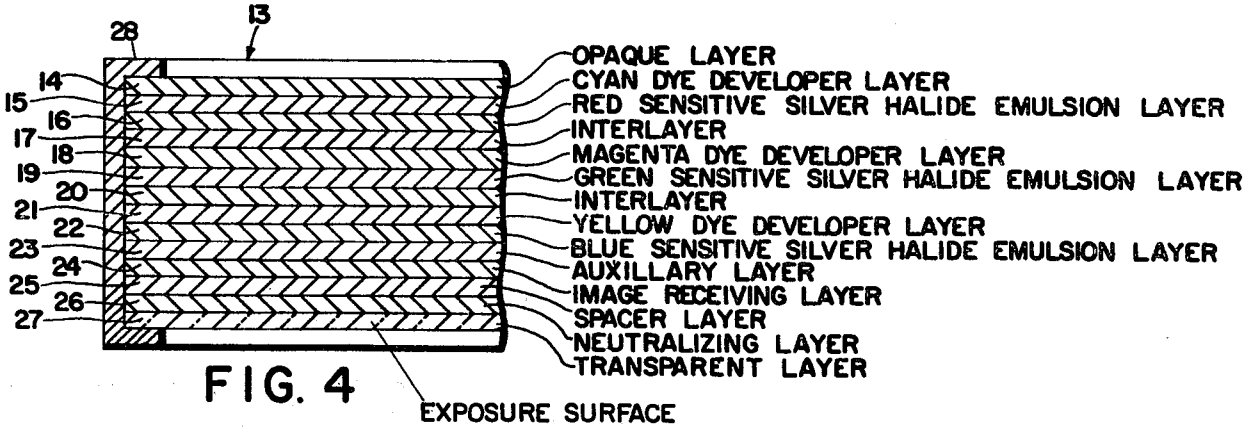

Referring now to FIGS. 3 and 4 there is shown a photographic product 10 of the type disclosed in U.S. Pat. No. 3,415,644. Essential elements of such products include a rupturable container 11 containing a processing composition comprising an opacifying system or agent, all of which is designated as 12, and, a photosensitive laminate 13 integrated with container 11.

Photosensitive laminate 13 includes, in order, dimensionally stable opaque layer 14, cyan dye-providing layer 15; red-sensitive silver halide emulsion layer 16; interlayer 17; magenta dye-providing layer 18, green-sensitive silver halide emulsion layer 19; interlayer 20; yellow dye-providing layer 21; blue-sensitive silver halide emulsion layer 22; auxiliary layer 23, which may contain an auxiliary silver halide developing agent; image-receiving layer 24, spacer layer 25; neutralizing layer 26; and dimensionally stable transparent layer 27 which permits photoexposure and viewing of a transfer image subsequently imparted to receiving layer 24.

The structural integrity of laminate 13 may be maintained, at least in part, by the adhesive capacity exhibited between the various layers comprising the laminate at their opposed surfaces. However, the adhesive capacity exhibited at an interface intermediate image-receiving layer 24 and the silver halide emulsion layer next adjacent thereto, for example, intermediate image-receiving layer 24 and auxiliary layer 23 as illustrated in FIGS. 3 and 4, should be less than that exhibited at the interface between the opposed surfaces of the remainder of the layers forming the laminate, in order to facilitate distribution of processing solution 12 intermediate the image-receiving layer 24 and the silver halide emulsion layer next adjacent thereto. The laminate's structural integrity may also be enhanced or provided, in whole or in part, by providing a binding member extending around, for example, the edges of laminate 13, and maintaining the layers comprising the laminate intact, except at the interface between layers 23 and 24 during distribution of alkaline solution 12 intermediate those layers. As illustrated in the Figures, the binding member may comprise a pressure-sensitive tape 28 securing and/or maintaining the layers of laminate 13 together at its respective edges. Tape 28 will also act to maintain processing solution 12 intermediate image-receiving layer 24 and the silver halide emulsion layer next adjacent thereto, upon application of compressive pressure to pod 11 and distribution of its contents intermediate the stated layers. Under such circumstances, binder tape 28 will act to prevent leakage of processing composition from the film unit's laminate during and subsequent to photographic processing. If the illustrated binder tapes are also opaque, edge leakage of actinic radiation incident on the emulsion or emulsions will also be prevented.

Details relating to the specific suitable materials employed in the fabrication of the above described layers and the dimensions, e.g., thickness, etc., of the layers as well as the ingredients of the processing composition and opacifying system together with the methods by which such products can be exposed and processed are all set forth in U.S. Pat. No. 3,415,644 which is hereby expressly incorporated herein by reference.

An especially preferred processing composition for photographic products of the present invention is one of the types disclosed in the commonly assigned Application Ser. No. 101,968, filed Dec. 28, 1970, by Edwin H. Land (now U.S. Pat. No. 3,647,437).

As an example of such a processing composition, mention may be made of the following:

| | |
|---|---|
| Water | 100 cc. |
| Potassium hydroxide | 11.2 gms |
| Hydroxyethyl cellulose (high viscosity) (commercially available from Hercules Powder Co., Wilmington, Delaware, under the trade name Natrasol 250) | 3.4 gms. |
| N-phenethyl-α-picolinium bromide | 2.7 gms. |
| Benzotriazole | 1.15 gms. |
| Titanium dioxide | 50.0 gms. |
| (A) | 2.08 gms. |

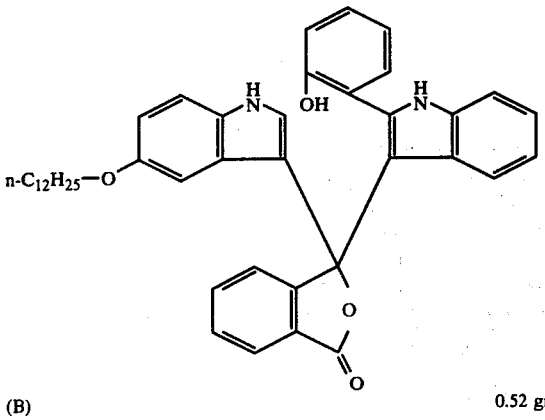

(B) 0.52 gms.

-continued

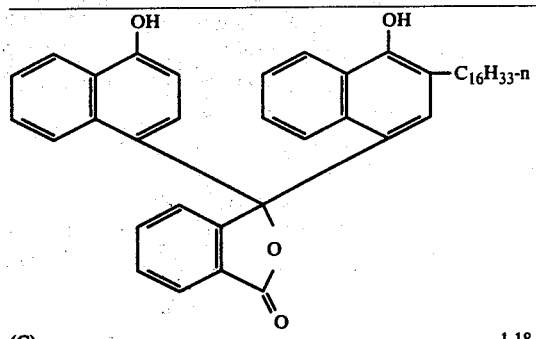

(C) 1.18 gms.

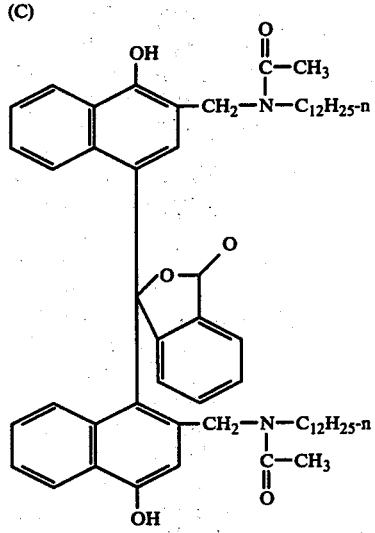

Figure 5:
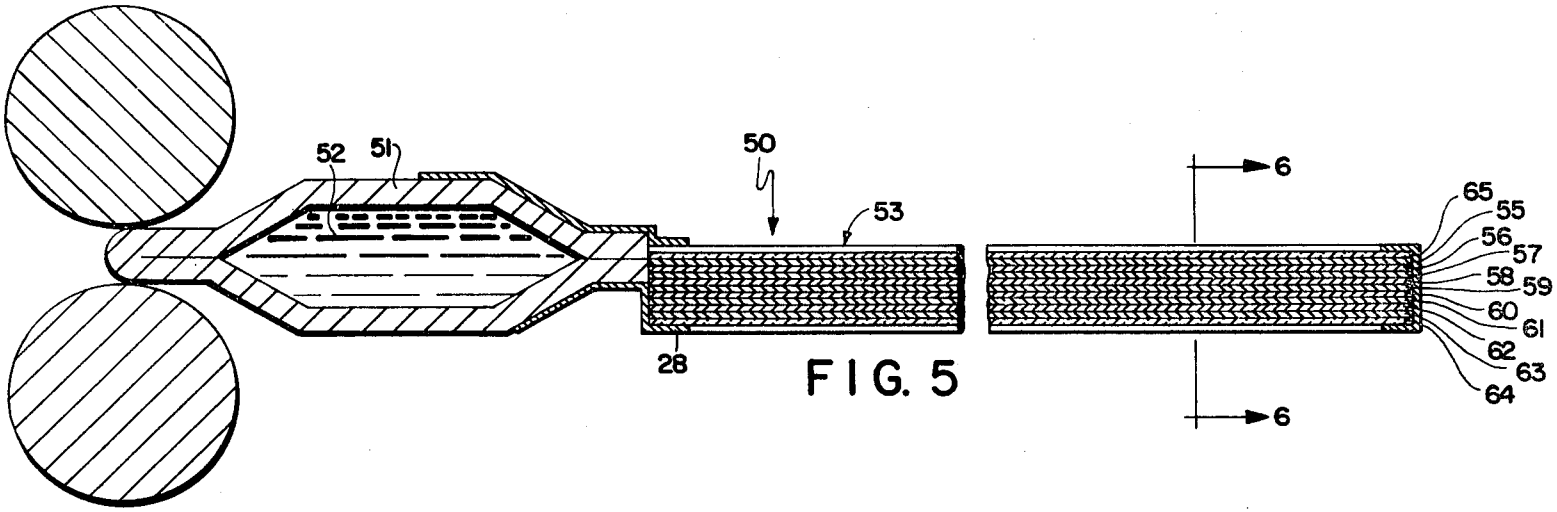
FIGS. 5 and 6 illustrate cross-sectional views of still another type of photographic product of the present invention.
Figure 6:
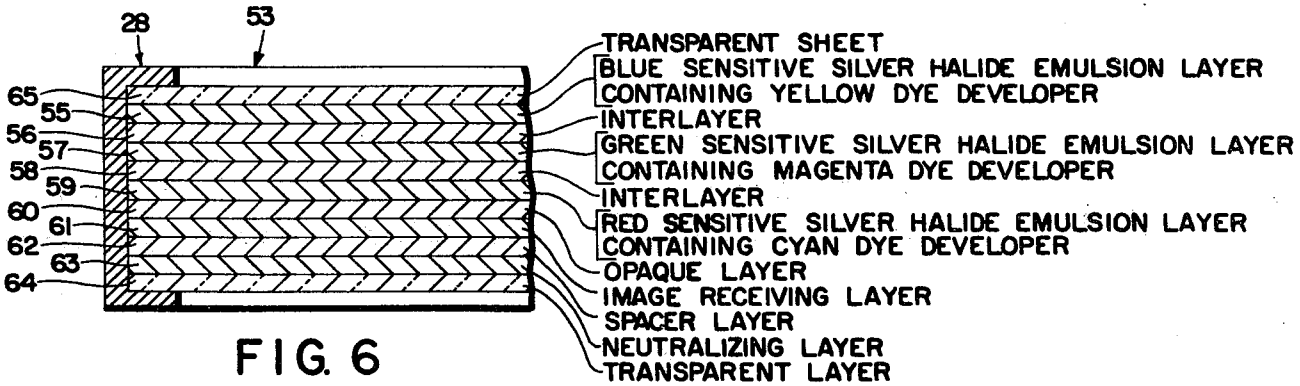

FIGS. 5 and 6 illustrate another photographic product of the type in which the above-mentioned fogging problem is obtained. Photographic products of this type are described in detail in U.S. Pat. No. 3,594,165. Essential elements of such products, e.g., film unit 50, include photosensitive laminate 53 and rupturable container 51 which retains aqueous alkaline solution 52. Photosensitive laminate 53 includes, in order, dimensionally stable transparent sheet 65; blue-sensitive silver halide emulsion layer 55 containing yellow dye providing material; interlayer 56; green-sensitive silver halide emulsion layer 57 containing magenta dye providing material; interlayer 58; red-sensitive silver halide emulsion layer 59 containing cyan dye providing material; opaque layer 60; image-receiving layer 61; spacer layer 62; neutralizing layer 63; and dimensionally stable transparent layer 64 both layer 64 and sheet 65 being fabricated of a processing composition impermeable flexible sheet material. The detailed description of such photographic products and of processes utilizing them as set forth in U.S. Pat. No. 3,594,165 is expressly incorporated herein by reference.

The unit may be provided with a binding member extending around, for example, the specified edges of the unit, maintaining the laminate and sheet elements comprising the unit intact except at the interface between the elements during distribution of processing composition 52. As illustrated in the Figures, the binding member may comprise a pressure-sensitive tape 28 securing the sheet and laminate elements together at the unit's specified edges. Tape 28 will also act to maintain processing composition 52 intermediate sheet 65 and photosensitive laminate 53 upon application of compressive pressure to container 51 and distribution of its contents intermediate the stated elements. Under such circumstances, binder tape 28 will act to prevent leakage of processing composition from the film unit during and subsequent to photographic processing. If the illustrated binder tapes are also opaque, edge leakage of actinic radiation incident on the emulsion or emulsions will also be prevented.

In film units of the type shown in FIGS. 3 and 4, the processing fluid is applied between the receiving layer and the next adjacent photosensitive stratum; whereas in film units of the type shown in FIGS. 5 and 6, the processing fluid is applied between the photosensitive laminate and a superposed element. Common to both systems is the fact that the side of the film unit to which the processing fluid is applied is transparent to actinic radiation due to the fact that the outer surface comprises a transparent sheet or layer and no suitable opacifying means is provided to protect the photosensitive strata from fogging by actinic light incident on this surface of the film unit prior to application of the processing fluid containing the particular opacifying material or materials needed for this purpose. As heretofore discussed, while the processing composition so applied will in fact obviate any fogging from light incident thereon when the film unit is brought into the light for development, the potential fogging of that portion of the film unit still in the camera and not yet protected by application of the processing fluid due to internal transmission of light does in fact exist.

In accordance with the practice of the present invention, the above described potential fogging problem is effectively eliminated in products of the type illustrated in FIGS. 3 and 4 including a chemical system of the type described before in a layer on the side of the photosensitive strata where the processing fluid is applied, e.g., in image receiving layer 24 of FIGS. 3 and 4 and in a layer on transparent layer 65 of FIGS. 5 and 6. As mentioned the chemical system included in such layers comprises a reagent or reagents which can effectively preclude this fogging and yet does not adversely affect the quality of the image which is obtained by exposure therethrough or to affect the quality of the image viewed through the chemical system containing layer. For optimum protection, the reagent or reagents are employed in an amount sufficient to provide an optical density, as measured edgewise at 700 m/$\mu$ over a path length of 1 inch, of at least about 5.0 and preferably 6.0, the amount of reagent further being insufficient to prevent transmission of substantially all of the light incident on the surface of the transparent layer so as not to interfere with the exposure of the photosensitive system. It will be appreciated that the precise amounts of reagent to accomplish this result may vary and is accordingly not capable of precise definitions. In any event, the precise amount of any given particular reagent required to prevent fogging in the film unit employed is readily ascertainable and will accordingly be apparent to those skilled in the art in the light of this disclosure and especially in light of the following discussion and Examples.

Figure 7:
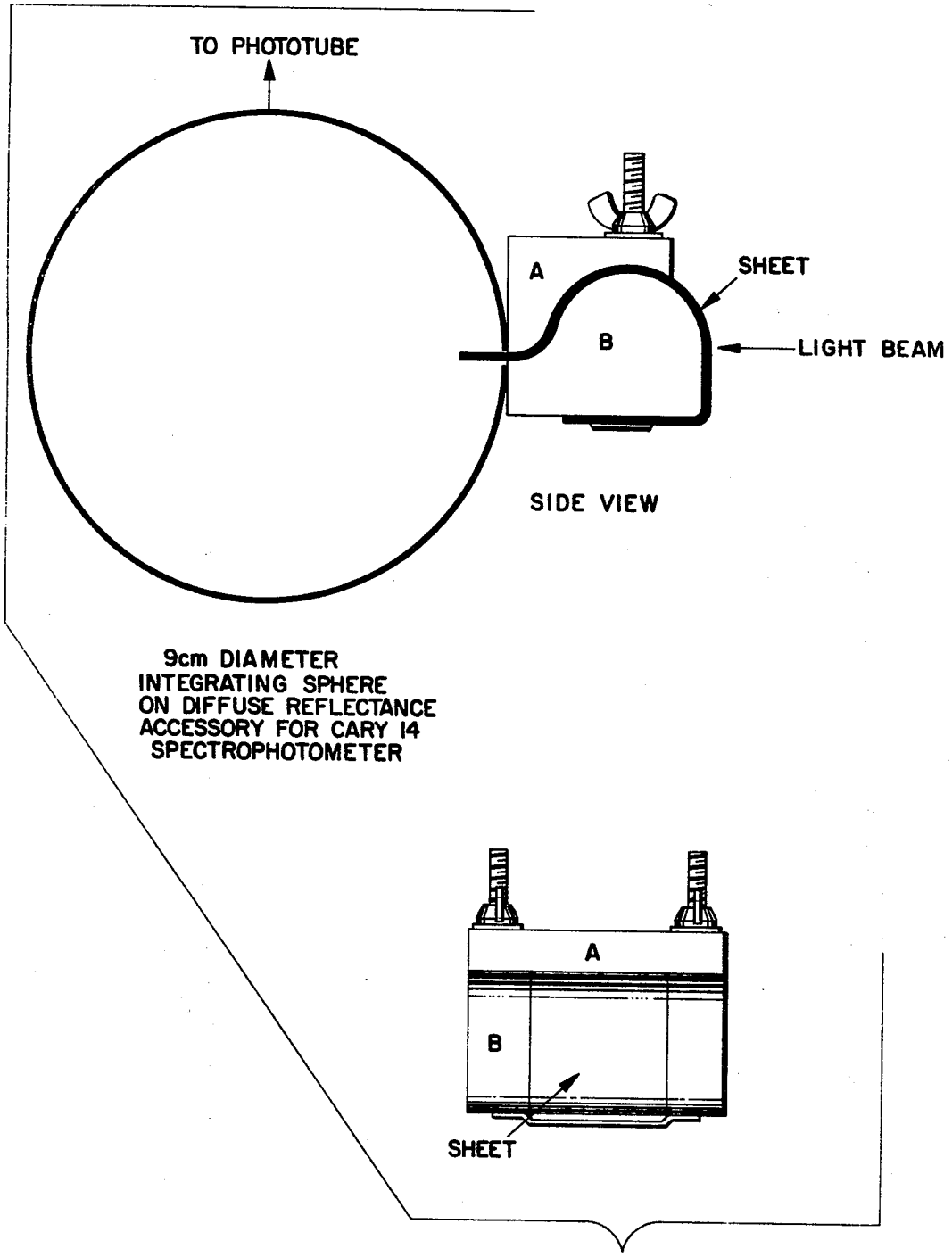
FIG. 7 illustrates means for measuring the light piping optical density of support layers of the present invention.

A simple method for measuring or determining the anti-light piping capability, e.g., optical density, of transparent layers is described below taken in connection with FIG. 7.

PROCEDURE FOR MEASURING ANTI-LIGHT-PIPING OPTICAL DENSITY (1) The sample sheet to be measured is cut to measure 1 inch × 4 inches.

(2) It is inserted in the black wooden block between parts (A) and (B) (See FIG. 2), such that ¼ inch protrudes at the exit slit, which will be placed up against the integrating sphere. The long end of the sample is wrapped around the semi-cyclindrical surface tightly, and the end taped securely to the flat side of the (B) block.

(3) The wing nuts are tightened.

(4) The Cary 14 is zeroed to 700 nm (m$\mu$) with nothing in the light path.

(5) The block is inserted into the light path of the Cary (as shown in the figure) so that the ¼ inch end of the sample sheet protrudes directly into the integrating sphere. The light beam then strikes the sample perpendicularly as shown.

(6) The optical density is measured at 700 nm, using filters as necessary to mask the reference beam in order to measure the densities which are greater than the normal maximum density scale (2.4).

EXAMPLES 1-11

The following Examples set forth in tabular fashion, illustrate amounts of particular reagents suitable for preventing fogging of the type described above. In each of the following Examples, the reagent(s), e.g., the designated dyes of Formulae 1-6, were dispersed in the 2:1 mixture of polyvinyl alcohol and poly-4-vinylpyridine used to prepare polymeric image-receiving layer 24 of film units of the type shown in FIGS. 3 and 4.

| Example No. | Dye(s) (Formula No.) | mgs./100 mls. of polyvinyl alcohol-poly-4-vinylpyridine mixture |
|---|---|---|
| 1. | 3 | 1 |
| | 5 | 0.1 |
| 2. | 3 | 0.5 |
| | 5 | 0.1 |
| 3. | 3 | 1.5 |
| | 5 | 0.15 |
| 4. | 3 | 1.5 |
| | 5 | 0.5 |
| 5. | 3 | 1.0 |
| | 5 | 0.3 |
| 6. | 3 | 0.5 |
| | 5 | 0.15 |
| 7. | 3 | 0.5 |
| | 5 | 0.075 |
| 8. | 3 | 0.25 |
| | 5 | 0.38 |
| 9. | 6 | 1.5 |
| | 2 | 0.8 |
| 3 | 0.25 | |
| | 5 | 0.075 |
| 11. | 3 | 0.25 |
| | 1 | 0.25 |

In each of the above Examples, the inclusion of the dye(s) in layer 24 of the units shown in FIGS. 3 and 4 imparted a light absorbing capability to the layer sufficient to prevent fogging of the photosensitive system until it was protected by the opacifying system. Also, since the above described dyes are "alkali fugitive", that is to say, they interact with the alkali processing composition to provide products which are not light absorbing, they do not interfere with the viewing of the image transferred to layer 24.

From the foregoing it will be apparent that the essence of the present invention resides in the discovery that fogging of photographic products wherein an opacifying system is distributed between an exposed photosensitive system and a transparent layer can be effectively eliminated by integrating with such products a chemical system which can initially provide a light absorption capability sufficient to prevent the fogging but yet insufficient to affect the quality of image patterns obtained by exposure through layers containing the system. Also the chemical system is further characterized in that it can interact with the processing composition to provide products which are not light absorbing and accordingly after interaction the layers are substantially transparent and do not affect or impair the quality of images viewed through such layers.

Accordingly, many modifications of features described for the purposes of illustrating the preferred embodiment of the invention may be made without departing from the spirit and scope of the invention defined in the appended claims. For example, it is to be understood that the accomplishments of the present invention are independent of the particular diffusion transfer photosensitive system described, e.g., a photosensitive system employing dye developers, and it is intended that other diffusion transfer photosensitive systems providing either positive or negative diffusion transfer images can be employed in the photographic products and processes defined in the claims appearing hereinafter.

Also while the invention has been described in detail in connection with those integral negative-positive film units adapted for forming color transfer images viewable, without separation, as color reflection prints, the invention is not restricted thereto. For example, the invention is adapted for use in receiving elements comprising a dyeable stratum contained on a transparent support which are placed in superposition with an exposed photosensitive element for processing in the light in the foregoing manner, regardless of whether the respective elements are intended to be maintained in superposition following image formation or whether they are intended to be separated thereafter, e.g., to provide color transparencies. It is also adaptable for use in film units wherein the negative and positive structures are initially contained together, e.g., laminated together as a unitary structure analogous to the film units shown in the illustrative drawings, but wherein the positive component containing the color transfer image is intended to be stripped or otherwise separated from the negative component following color image formation.

While the invention is primarily directed to color photography, it will be apparent that it is equally adapted for use in analogous film units for forming black-and-white images, e.g., silver diffusion transfer images. Such a film unit may, for example, comprise a laminar structure including, in order, an opaque dimensionally stable layer, a light-sensitive silver halide layer, a silver-receptive stratum of known description and a transparent layer containing the above-described light-absorbing reagents. Development of such an exposed film unit including distributing an opacifying system, including a light-reflecting agent, between the transparent layers and exposed silver halide layer will provide a composite print including a negative image and a silver diffusion transfer image, with a layer of light-reflecting agent therebetween, so that said silver transfer image is viewable by reflection without separating said layers.

Having described the invention together with preferred embodiments as well as manners of practicing same, what I declare as new and desire to secure by U.S. Letters Patent is as follows.

What is claimed is:

1. A diffusion transfer film unit adapted (a) for photoexposure in a dark chamber of a camera, (b) for withdrawal from said dark chamber while distributing an opaque processing composition between superposed sheet-like elements of the film unit, and (c) for transportation from the camera into light before the opaque processing composition has been completely distributed, said film unit comprising:

a first sheet-like element comprising an opaque support carrying a plurality of layers including at least one photosensitive silver halide layer associated with a diffusion transfer process dye image-providing material;

a rupturable container releasably holding an aqueous, alkaline, opaque processing composition including a light-reflecting pigment;

a second sheet-like element comprising a transparent support carrying an image-receiving layer, a transparent layer carried by said transparent support containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered non-light-absorbing by interaction with said aqueous alkaline processing composition;

said first and second sheet-like elements being held in superposed, fixed relationship, with said supports outermost, during photoexposure and processing, said photosensitive silver halide emulsion layer(s) being exposable through said transparent support and said dye containing layer;

said rupturable container being positioned transverse one end of said film unit so as to release said opaque processing composition for distribution between said sheet-like elements to provide an opaque processing composition layer positioned between said dye containing layer and said silver halide layer(s) subsequent to photoexposure, said dye containing layer and the distribution of said opaque processing composition being effective to prevent fogging of said photosensitive silver halide layer(s) by light incident on the surface of said transparent support and transmitted therethrough during distribution of said processing composition, said processing composition providing a light-reflecting layer against which a color transfer image formed in said image-receiving layer may be viewed through said transparent support without separation of said superposed first and second sheet-like elements.

2. A film unit of claim 1 wherein said image-receiving layer contains said dye.

3. A film unit of claim 1 wherein said quantity of dye in said dye containing layer is about 2 mgms. of dye per 5 grams of polymer of said layer.

4. A diffusion transfer film unit adapted (a) for photoexposure in a dark chamber of a camera, (b) for withdrawal from said dark chamber while distributing an opaque processing composition between superposed sheet-like elements of the film unit and (c) for transportation from the camera into light before the opaque processing composition has been completely distributed, said film unit comprising a plurality of layers maintained in substantially fixed relationship during and after photoexposure by an opaque binding tape extending around the edges of the unit to prevent edge leakage of light and where said unit comprises;

a first sheet-like element comprising an opaque support carrying a plurality of layers including at least one photosensitive silver halide layer associated with a diffusion transfer process dye image-providing material;

a rupturable container releasably holding an aqueous, alkaline, opaque processing composition including a light-reflecting pigment;

a second sheet-like element comprising a transparent support carrying an image-receiving layer, a transparent layer carried by said transparent support containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered non-light-absorbing by interaction with said aqueous alkaline processing composition;

said first and second sheet-like elements being held in superposed, fixed relationship, with said supports outermost, during photoexposure and processing, said photosensitive silver halide emulsion layer(s) being exposable through said dye containing layer;

said rupturable container being positioned transverse one end of said film unit so as to release said opaque processing composition for distribution between said sheet-like elements to provide an opaque processing composition layer positioned between said dye containing layer and said photosensitive layer(s) subsequent to photoexposure, said dye containing layer and the distribution of said opaque processing composition being effective to prevent fogging of said photosensitive silver halide layer(s) by light incident on the surface of said transparent support and transmitted therethrough during distribution of said processing composition, said processing composition providing a light-reflecting layer against which a color transfer image formed in said image-receiving layer may be viewed through said transparent support without separation of said superposed first and second sheet-like elements.

5. A film unit of claim 4 where said image-receiving layer contains said dye.

6. A film unit of claim 4 wherein said quantity of dye in said dye containing layer is about 2 mgms. of dye per 5 grams of polymer of said layer.

7. A diffusion transfer film unit adapted (a) for photoexposure in a dark chamber of a camera, (b) for withdrawal from said dark chamber while distributing an opaque aqueous alkaline processing composition between superposed sheet-like elements of the film unit, and (c) for transportation from the camera into light before the opaque processing composition has been completely distributed, said film unit comprising:

a first sheet-like element comprising a first transparent support carrying a transparent layer containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered non-light-absorbing by interaction with said aqueous alkaline processing composition;

a second sheet-like element comprising a second transparent support carrying, in sequence, an image-receiving layer, an opaque layer and at least one photosensitive silver halide layer associated with a diffusion transfer process dye image-providing material;

a rupturable container releasably holding an aqueous, alkaline, opaque processing composition;

said first and second sheet-like elements being held in superposed, fixed relationship, with said supports outermost, during photoexposure and processing, said photosensitive silver halide emulsion layer(s) being exposable through said first transparent support and said dye containing layer;

said rupturable container being positioned transverse one end of said film unit so as to release said processing composition for distribution to provide an opaque processing composition layer positioned between said dye containing layer and said photosensitive silver halide layer(s); said dye containing layer and the distribution of said processing composition being effective to prevent fogging of said photosensitive silver halide layer(s) by light incident on the surface of said first transparent support and transmitted therethrough during distribution of said processing composition.

8. A film unit of claim 7 wherein said quantity of dye in said dye containing layer is about 2 mgms. of dye per 5 grams of polymer of said layer.

9. A diffusion transfer film unit adapted (a) for photoexposure in a dark chamber of a camera, (b) for withdrawal from said dark chamber while distributing an opaque aqueous alkaline processing composition between superposed sheet-like elements of the film unit, and (c) for transportation from the camera into light before the opaque processing composition has been completely distributed, said film unit comprising a plurality of layers maintained in substantially fixed relationship during and after photoexposure by an opaque binding tape extending around the edges of the unit to prevent edge leakage of light and where said film unit comprises;

a first sheet-like element comprising a first transparent support carrying a transparent layer containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered non-light-absorbing by interaction with said aqueous alkaline processing composition;

a second sheet-like element comprising a second transparent support carrying, in sequence, an image-receiving layer, an opaque layer and at least one photosensitive silver halide layer associated with a diffusion transfer process dye image-providing material;

a rupturable container releasably holding an aqueous, alkaline, opaque processing composition;

said first and second sheet-like elements being held in superposed, fixed relationship, with said supports outermost during photoexposure and processing, said photosensitive silver halide emulsion layer(s)

being exposable through said first transparent support and said dye containing layer;

said rupturable container being positioned transverse one end of said film unit so as to release said processing composition for distribution to provide an opaque processing composition layer positioned between said dye containing layer and said photosensitive silver halide layer(s), said dye containing layer and the distribution of said processing composition being effective to prevent fogging of said photosensitive silver halide layer(s) by light incident on the surface of said first transparent support and transmitted therethrough during distribution of said processing composition.

10. A film unit of claim 9 wherein said quantity of dye in said dye containing layer is about 2 mgms. of dye per 5 grams of polymer of said layer.

11. A composite photographic, color, diffusion transfer film unit comprising a plurality of layers maintained in substantially fixed relationship during and after photoexposure by an opaque binding tape extending around the edges of the unit to prevent edge leakage of light and which includes in order, a transparent support, an image-receiving layer adapted to receive and exhibit for viewing a transfer dye image and containing a quantity of a dye effective to reduce the light-piping capability of said image-receiving layer, said quantity further being effective to impart to said dye containing image-receiving layer an optical density greater than about 5 as measured edgewise at 700 mμ over a path length of 1 inch, but said quantity of dye being insufficient to prevent effective exposure through said image-receiving layer, said dye being adapted to be rendered non-light-absorbing by interaction with an aqueous, alkaline processing composition, a photosensitive silver halide layer associated with a diffusion transfer process dye image-providing material, and an opaque layer, and means retaining an aqueous, alkaline, opaque diffusion transfer processing composition including a light reflecting agent for distribution, after photoexposure, between said image-receiving layer and said photosensitive layer.

12. A film unit of claim 11 where said quantity of dye in said image receiving layer is about 2 mgms. of dye per 5 grams of polymer of said layer.

13. A diffusion transfer photographic process comprising the steps of:

(A) photoexposing a diffusion transfer film unit in a dark chamber positioned within a camera, said diffusion transfer film unit comprising:

a first sheet-like element comprising an opaque support carrying a plurality of layers including at least one photosensitive silver halide layer associated with a diffusion transfer process dye image-providing material;

a rupturable container releasably holding an aqueous alkaline, opaque processing composition including a light-reflecting pigment, said rupturable container being positioned transverse a leading edge of said film unit so as to release said processing composition for distribution between said first sheet-like element and a second sheet-like element subsequent to photoexposure;

said second sheet-like element comprising a transparent support carrying an image-receiving layer, a transparent layer carried by said support containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered non-light-absorbing by interaction with said aqueous alkaline processing composition;

said first and second sheet-like elements being held in superposed, fixed relationship during photoexposure and processing, said photosensitive silver halide emulsion layer(s) being exposed through said second transparent support and said dye containing layer;

(B) withdrawing the photoexposed film unit from the dark chamber by passing the photoexposed film unit between a pair of pressure applying members to distribute the contents of the container between said sheet-like elements to provide an opaque, processing composition layer positioned between said dye containing layer and said photosensitive layer(s) and covering those portions of the photoexposed silver halide emulsion layer(s) emerging from the dark chamber; and, (C) transporting those covered portions into light before the opaque processing composition is distributed over all portions of the photoexposed silver halide layer(s), said covered portions and said quantity of dye in said transparent layer being effective during distribution of said processing composition to prevent light incident on said covered portions from fogging said photoexposed photosensitive layer(s), said distributed processing composition providing a light reflecting layer against which a color transfer image formed in the image receiving layer may be viewed through said transparent support without separation of said superposed first and second sheet-like elements.

14. A process of claim 13 where said image-receiving layer contains said dye.

15. A process of claim 13 where said quantity of dye in said dye containing layer is about 2 mgms. of dye per 5 grams of polymer of said layer.

16. A diffusion transfer photographic process comprising the steps of:

(A) photoexposing a diffusion transfer film unit in a dark chamber positioned within a camera, said diffusion transfer film unit having a plurality of layers maintained in substantially fixed relationship during and after photoexposure by an opaque binding tape extending around the edges of the unit to prevent edge leakage of light and wherein said film unit comprises;

a first sheet-like element comprising an opaque support carrying a plurality of layers including at least one photosensitive silver halide layer associated with a diffusion transfer process dye image-providing material;

a rupturable container releasably holding an aqueous, alkaline, opaque processing composition including a light-reflecting pigment, said rupturable container being positioned transferse a leading edge of said film unit so as to release said processing composition for distribution between said first sheet-like element and a second sheet-like element subsequent to photoexposure;

said second sheet-like element comprising a transparent support carrying an image-receiving layer, a transparent layer carried by said support containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered nonlight-absorbing by interaction with said aqueous alkaline processing composition;

said first and second sheet-like elements being held in superposed, fixed relationship during photoexposure and processing, said photosensitive silver halide emulsion layer(s) being exposed through said second transparent support and said dye containing layer;

(B) withdrawing the photoexposed film unit from the dark chamber by passing the photoexposed film unit between a pair of pressure applying members to distribute the contents of the container between said sheet-like elements to provide an opaque processing composition layer positioned between said dye containing layer(s) and covering those portions of the photoexposed silver halide emulsion layer(s) emerging from the dark chamber; and, (C) transporting those covered portions into light before the opaque processing composition is distributed to all portions of the photoexposed silver halide layer(s), said covered portions and said quantity of dye in said transparent layer being effective during distribution of said processing composition to prevent light incident on said covered portions from fogging said photoexposed photosensitive layer(s), said distributed processing composition providing a light reflecting layer against which a color transfer image can be viewed through said transparent support without separation of said superposed first and second elements.

17. A diffusion transfer photographic process comprising the steps of:

(A) photoexposing a diffusion transfer film unit in a dark chamber positioned within a camera; said diffusion transfer film unit comprising:

a first sheet-like element comprising a first transparent support carrying a transparent layer carried by said transparent support containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered nonlight-absorbing by interaction with an aqueous alkaline processing composition;

a second sheet-like element comprising a second transparent supporting carrying, in sequence, an image-receiving layer, an opaque layer and at least one photosensitive silver halide layer associated with a diffusion transfer process dye image-providing material;

a rupturable container releasably holding an aqueous, alkaline, opaque processing composition, said rupturable container being positioned transverse one end of said film unit so as to release said processing composition for distribution between said sheet like elements;

said first and second sheet-like elements being held in superposed, fixed relationship, with said supports outermost, during photoexposure and processing, said photosensitive silver halide emulsion layer(s) being exposed through said first sheet-like element;

(B) withdrawing the photoexposed film unit from the dark chamber by passing the photoexposed film unit between a pair of pressure applying members to distribute the contents of the container between said sheet-like elements to provide an opaque processing composition layer positioned between said dye containing layer and said silver halide layer(s) and covering those portions of the photoexposed silver halide layer(s) emerging from the dark chamber; and (C) transporting those covered portions into light before the opaque processing composition is distributed over all portions of the photoexposed silver halide layer(s), said covered portions and said quantity of dye in said layer carried by said support being effective during distribution of said processing composition to prevent light incident on said covered portions from fogging said photoexposed photosensitive layer(s).

18. A process of claim 17 where said quantity of dye in said dye containing layer is about 2 mgms. of dye per 5 grams of polymer of said layer.

19. A diffusion transfer photographic process comprising the steps of:

(A) photoexposing a diffusion transfer film unit in a dark chamber positioned within a camera; said diffusion transfer film unit having a plurality of layers maintained in substantially fixed relationship during and after photoexposure by an opaque binding tape extending around the edges of the unit to prevent edge leakage of light and wherein said film unit comprises;

a first sheet-like element comprising a first transparent support carrying a transparent layer containing a quantity of a dye effective to reduce the light-piping capability of said transparent layer, said quantity further being effective to impart to said dye containing layer an optical density greater than about 5 as measured edgewise at 700 mμ over a path length of 1 inch, said dye being adapted to be rendered nonlight-absorbing by interaction with an aqueous alkaline processing composition;

a second sheet-like element comprising a second transparent support carrying in sequence, an image-receiving layer, an opaque layer and at least one photosensitive silver halide layer associated with a diffusion transfer process dye image-providing material;

a rupturable container releasably holding an aqueous, alkaline, opaque processing composition, said rupturable container being positioned transverse said one end of said film unit so as to release said processing composition for distribution between said sheet like elements;

said first and second sheet-like elements being held in superposed, fixed relationship, with said supports outermost, during photoexposure and processing, said photosensitive silver halide emulsion layer(s) being exposed through said first sheet-like element;

(B) withdrawing the photoexposed film unit from the dark chamber by passing the photoexposed film unit between a pair of pressure applying members to distribute the contents of the container between said sheet-like elements to provide an aqueous processing composition layer positioned between said dye containing layer and said photosensitive layer(s) and covering those portions of the photoexposed silver halide layer(s) emerging from the dark chamber; and (C) transporting those covered portions into light before the opaque processing composition is distributed to all portions of the photoexposed silver halide layer(s), said covered portions and said quantity of dye in said layer carried by said support being effective during distribution of said processing composition to prevent that light incident on said covered portions from fogging said photoexposed photosensitive layers.

* * * * *

UNITED STATES PATENT AND TRADEMARK OFFICE

CERTIFICATE OF CORRECTION

PATENT NO. : 4,138,254

DATED : February 6, 1979

INVENTOR(S) : Howard G. Rogers

It is certified that error appears in the above-identified patent and that said Letters Patent are hereby corrected as shown below:

Column 1, line 8, after "1973" insert --(now abandoned)--.

Column 1, line 22, "image-receiver" should be --image-receiving--.

Column 2, line 15, "imageproviding" should be --image-providing--.

Column 3, line 2, after "and" insert --a--.

Column 3, line 35, after "mixture" change "or" to --of--.

Column 7, line 4, "FIGS." should be --FIG.--.

Column 12, in the Table at line 53, column headed "Example No.", should read --10--; the entry "0.25" in the column headed "Dye(s) (Formula No.)", should read --3--; the blank in the column headed "mgs./100 mls. of polyvinyl alcohol-poly-4-vinylpyridine mixture", should read --0.25--.

Column 18, line 60, "transferse" should be --transverse--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*